US005827056A

United States Patent [19]

Rohrbaugh et al.

[11] Patent Number: 5,827,056

[45] Date of Patent: Oct. 27, 1998

[54] DEVICE AND METHOD FOR IMPROVING STRIP TRACKING IN A CONTINUOUS HEATING FURNACE

[75] Inventors: David S. Rohrbaugh, Sellersville; Steven R. Peterson, Huntingdon Valley, both of Pa.

[73] Assignee: Drever Company, Huntingdon Valley, Pa.

[21] Appl. No.: 780,807

[22] Filed: Jan. 9, 1997

[51] Int. Cl.[6] ..... F26B 13/08

[52] U.S. Cl. ..... 432/8; 148/511; 148/657; 266/87

[58] Field of Search ..... 432/8; 148/511, 148/645, 657; 266/87

[56] References Cited

U.S. PATENT DOCUMENTS

| | | | |
|---|---|---|---|
| 2,902,572 | 9/1959 | Lackner et al. | 219/10.41 |
| 3,186,694 | 6/1965 | Beggs | 432/8 |
| 3,444,346 | 5/1969 | Russell et al. | 219/10.61 |
| 4,054,770 | 10/1977 | Jackson et al. | 219/10.61 R |
| 4,239,483 | 12/1980 | Iida et al. | 432/8 |
| 4,243,441 | 1/1981 | Wilson | 432/8 |
| 4,316,717 | 2/1982 | Thome | 432/8 |
| 4,404,043 | 9/1983 | Elhaus et al. | 266/87 |
| 4,571,274 | 2/1986 | Yanagishima et al. | 148/657 |
| 4,585,916 | 4/1986 | Rich | 219/10.61 R |
| 4,678,883 | 7/1987 | Saitoh et al. | 219/10.61 R |
| 4,878,961 | 11/1989 | Yamaguchi et al. | 148/511 |

FOREIGN PATENT DOCUMENTS

| | | | |
|---|---|---|---|
| 0011729 | 1/1990 | Japan | 148/657 |

*Primary Examiner*—Teresa J. Walberg
*Assistant Examiner*—Gregory Wilson
*Attorney, Agent, or Firm*—Woodcock Washburn Kurtz Mackiewicz & Norris LLP

[57] ABSTRACT

A method and tracking system for optimizing the tracking of a metal strip traveling over a plurality of crowned rolls in a continuous heating system designed to track a design strip having a design strip temperature profile. The invention attains an actual strip temperature profile in the metal strip that approximately coincides with the design strip temperature profile. This is accomplished by inputting metal strip variables and heating system variables into a control system and directing the control system to access a thermal model and a design strip temperature profile model. The control system then directs the operation of the heating system based on the metal strip variables, the heating system variables, the thermal model and the design strip temperature profile model such that the metal strip is heated to have an actual strip temperature profile that approximately coincides with the design strip temperature profile.

18 Claims, 5 Drawing Sheets

DEVICE AND METHOD FOR IMPROVING STRIP TRACKING IN A CONTINUOUS HEATING FURNACE

BACKGROUND OF THE INVENTION

1. Field of the Invention

This invention generally relates to the field of continuous heating furnaces for heating metal strips. More specifically, this invention relates to improvements in tracking metal strips traveling through a continuous heating furnace.

2. Description of the Prior Art

Continuous heating furnaces, or heating systems, are used for heating metal strips traveling through a metal processing system, such as a continuous strip annealing line or a continuous strip galvanizing line. These heating furnaces consist of one or more vertical passes through which the strips are continuously conveyed by rolls located at the top and bottom of the passes. To ensure that the strips track straight through the furnace, without weaving or contacting the furnace interior walls, the cylindrical surfaces of the rolls generally do not have a flat profile but a crown profile that provides a self-centering force to the strip.

Referring now to FIG. 1, crowned roll 1 has a crown profile 2 on the cylindrical surface 7 of the roll. The crown profile 2 provides the roll 1 with a center section 3 having a diameter 4 that is larger than the diameter 6 of the outer edges 5, such that the cylindrical surface 7 crowns in the middle. With the crown profile 2, the surface speed of the roll 1 is higher in the center section 3 than on the outer edges 5, which creates a natural centering force on metal strip 8.

The profile of the cylindrical surface of a roll will be different in the operating furnace than when the roll is at room temperature. The difference in the profile is caused by the thermal effects of the furnace and the strip on the crowned roll. These thermal effects are especially troublesome in the beginning section of the heating system where the strip temperature is much lower than the furnace temperature. Under these conditions, the roll edges 5 are exposed to the high temperature heating system heat and have a greater increase in diameter than the center section 3 which is exposed to the cooler strip. As the edges have a greater increase in size relative to the center, a dished section 9 is formed in the center section 3 during operation, as shown in FIG. 2. A roll with a dished section causes the strip to track poorly by weaving and, very possibly, hitting the interior walls of the heating system.

To counteract the potential for forming a dished section, the crowned rolls are given "extra crown," meaning that the diameter 4 of center section 3 of the crowned roll 1 is made even larger relative to diameter 6 of the ends 5. This "extra crown" enables the crowned rolls to maintain some crown profile, and not dish, when the edges 5 and the center 3 are exposed to temperature differences.

However, a crowned roll may have too much "extra crown," which results in too much centering force that causes the strip to track poorly and, very possibly, "buckle." When a strip buckles, it folds over onto itself. When there is too much centering force, the left and right sides of the strip travel to the center of the roll. In doing so, the center of the strip is forced up and off the cylindrical surface of the roll. Once the center of the strip is off the roll, the strip buckles if the center of the strip falls over onto the left or right side of the strip. Too much extra crown can also cause concentrated forces in the strip which can result in localized yielding of the strip.

Designers select appropriate crowned roll profiles based on the design specifications of the heating system. The design specifications of a continuous heating system are traditionally based on a design heating system temperature profile that will enable a design strip—a theoretical metal strip typically having the characteristics of the average metal strip that is expected to be processed—to attain a design strip temperature profile while traveling through the heating system at a design speed. The design strip temperature profile is the relationship of design strip temperatures at different locations in the heating system. Likewise, the design heating system temperature profile is the relationship of heating system temperatures at different locations in the heating system. Using the design strip and heating system temperature profiles, designers traditionally design the crown profile of each roll based on the heating system temperature and the design strip temperature at a roll's location.

However, strip tracking problems occur when the rolls' profiles change as a result of the rolls being exposed to actual strip and actual heating system temperature profiles that are different from the design strip and design heating system temperature profiles. The actual strip temperature profile is the relationship of the temperatures of an actual strip traveling through the heating system at different locations in the heating system. Likewise, the actual heating system temperature profile is the relationship of heating system temperatures at different locations in the heating system during operation.

The actual and design temperature profiles are different when the heating system operates at reduced capacity or some other condition. For example, when the heating system operates at reduced capacity by not maintaining the design speed of the strips through the heating system, the strips heat up much faster, resulting in an elevated actual strip temperature profile compared to the design strip temperature profile. The elevated actual strip temperature profile results in crowned rolls having too much crown as the hotter strip overheats the center section of the crowned roll. When the rolls have too much crown, the strips track poorly and, very possibly, buckle.

Heating system operators adjust the heating system to compensate for reduced capacity, which results in other problems. Continuing with the above example of a heating system heating strip with a speed lower than the design speed, a heating system operator reduces the temperatures in the heating system so as not to overheat the strip and, as a result, the crowned rolls. However, if the operator overcools the heating system, the actual strip temperature profile will be lower than the design strip temperature profile. The lower actual strip temperature profile results in the crowned rolls losing their crowned profile, or dishing, and the strip tracking poorly by weaving.

In U.S. Pat. No. 4,878,961 (Yamaguchi et al.)("'961"), the strip tracking problem was addressed by changing the tension of the metal strip as a function of the thermal crown of the crowned rolls. The magnitude of the self-centering force is variable depending on the magnitude of the tension exerted on the metal strip as well as the shape of the rolls' profiles. Based on this principle, '961 discloses a system for changing the tension on the metal strip to compensate for changes in rolls' profiles due to thermal effects. However, this system is expensive and complicated.

Thus, a need exists for a device and method to economically and simply ensure strip tracking as a metal strip travels through a continuous heating furnace.

SUMMARY OF THE INVENTION

The present invention is directed toward a method and system of optimizing the tracking of metal strips in a continuous heating system by heating the crowned rolls such that they maintain their approximate, designed-for cylindrical profile.

It is an objective of the invention to provide a method and tracking system for optimizing the tracking of a metal strip traveling over a plurality of crowned rolls in a continuous heating system designed to track a design strip having a design strip temperature profile. The invention attains an actual strip temperature profile in the metal strip that approximately coincides with the design strip temperature profile. This is accomplished by inputting metal strip variables and heating system variables into a control system and directing the control system to access a thermal model and a design strip temperature profile model. The control system then directs the operation of the heating system based on the metal strip variables, the heating system variables, the thermal model and the design strip temperature profile model such that the metal strip is heated to have an actual strip temperature profile that approximately coincides with the design strip temperature profile.

BRIEF DESCRIPTION OF THE DRAWINGS

Prior Art

Prior Art

DESCRIPTION OF THE PREFERRED EMBODIMENT(S)

Figure 1:
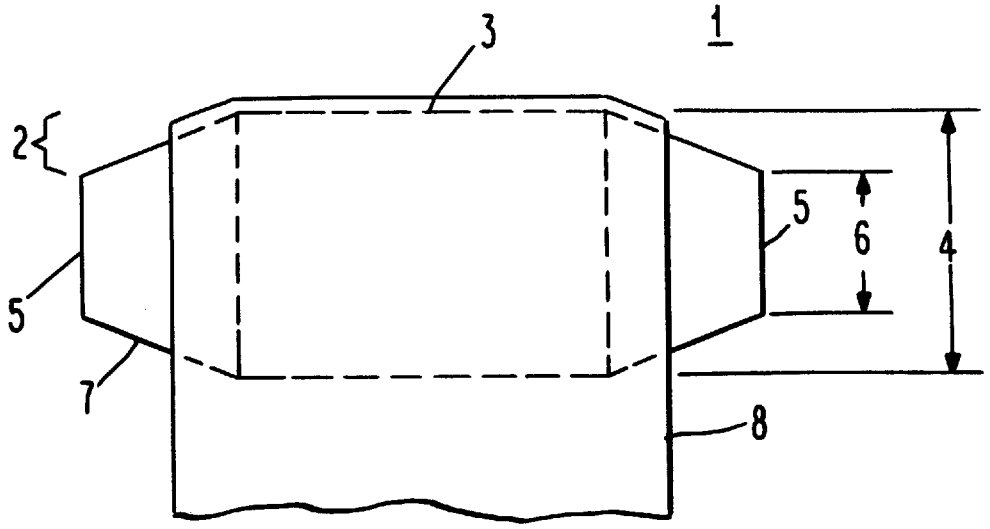
Fig. 1 PRIOR ART
FIG. 1 is a view of a crowned roll with a metal strip centered thereon.
Figure 2:
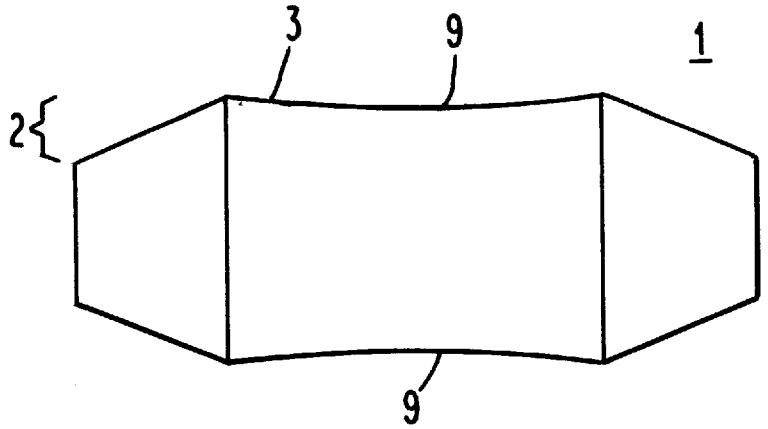
Fig. 2 PRIOR ART
FIG. 2 is a view of a dished crowned roll.
Figure 3:
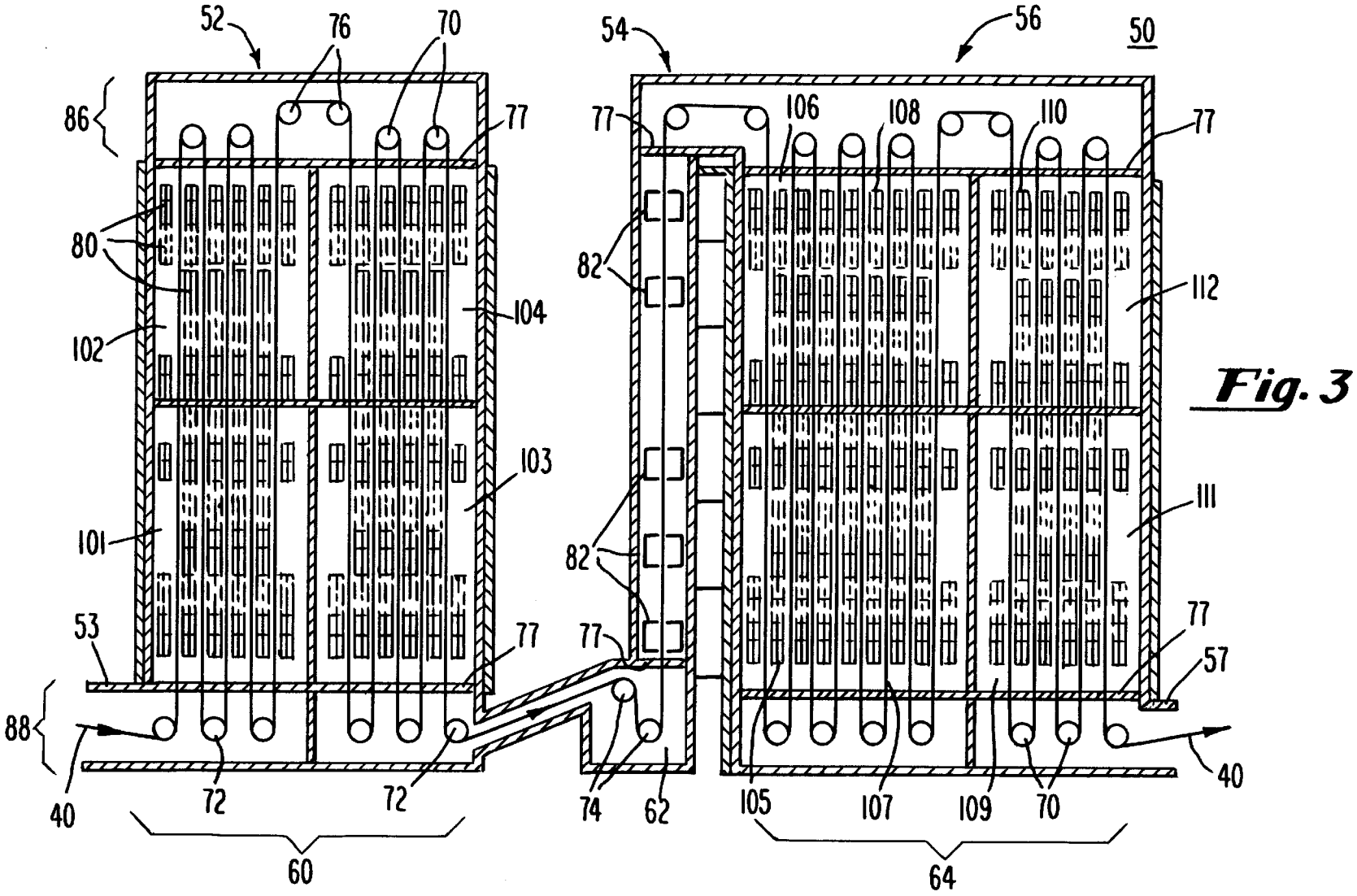
FIG. 3 is an elevation view of the heating system comprising an induction heating section between a preceding and a following heating sections.

Referring to the drawings, wherein like numbers designate like components, FIG. 3 illustrates heating system 50, or furnace, for heating a continuously moving strip 40. Heating system 50 is located upstream of a soaking section and down stream of a preheating section in a continuous steel strip annealing line. Other invention embodiments are useful in continuous strip galvanizing lines. The heating system 50 has a top section 86 and a bottom section 88 extending across a preceding heating section 52, an induction heating section 54, and a following heating section 56 arranged in series. Other embodiments of the invention have other combinations of heating sections, including having multiple preceding, induction, or following heating sections; having no induction heating section; or having the induction heating section in other positions. Further embodiments of the invention have the heating sections 52, 54 and 56 arranged vertically. These arrangements enable metal strip 40 to enter the preceding heating section 52 at entrance 53, pass through the three heating sections, and exit through the following heating section exit 57.

The metal strip 40 travels through the heating sections 52, 54, and 56 in passes 60, 62, and 64 respectively. A pass is a space extending from either the top section 86 to the bottom section 88 or vice versa, through which the metal strip 40 travels. In the embodiment of FIG. 3, there are ten passes 60 in the preceding heating section 52, one pass 62 in the induction heating section 54, and thirteen passes 64 in the following heating section 56. While the passes in the embodiment of FIG. 3 are vertically oriented, other embodiments of the invention may have passes oriented in other directions, such as horizontal.

In negotiating the passes, the metal strip 40 travels over rolls 70, tensiometer rolls 72, bridle rolls 74, and steering rolls 76, which are located in the top and bottom sections 86 and 88. While all of the rolls support the metal strip 40 as it travels through the passes, some rolls have additional purposes. Tensiometer rolls 72 measure the tension in the metal strip 40 while bridle rolls 74 change the tension in it. Steering rolls 76 control the direction of the metal strip 40.

The rolls 70, tensiometer rolls 72, and steering rolls 76 have a crown profile constructed to track the strip 40 without weaving or buckling when each roll is exposed to its respective design heating system temperature and design strip temperature as defined by a design heating system temperature profile and a design strip temperature profile, respectively. The heating system is designed to track a design strip traveling through the heating system while the heating system is being heated to a design heating system temperature profile. The design heating system temperature profile is a temperature of the heating system 50 at different locations in the heating system that enables the design strip to travel therethrough at its design strip temperature profile.

Figure 4:
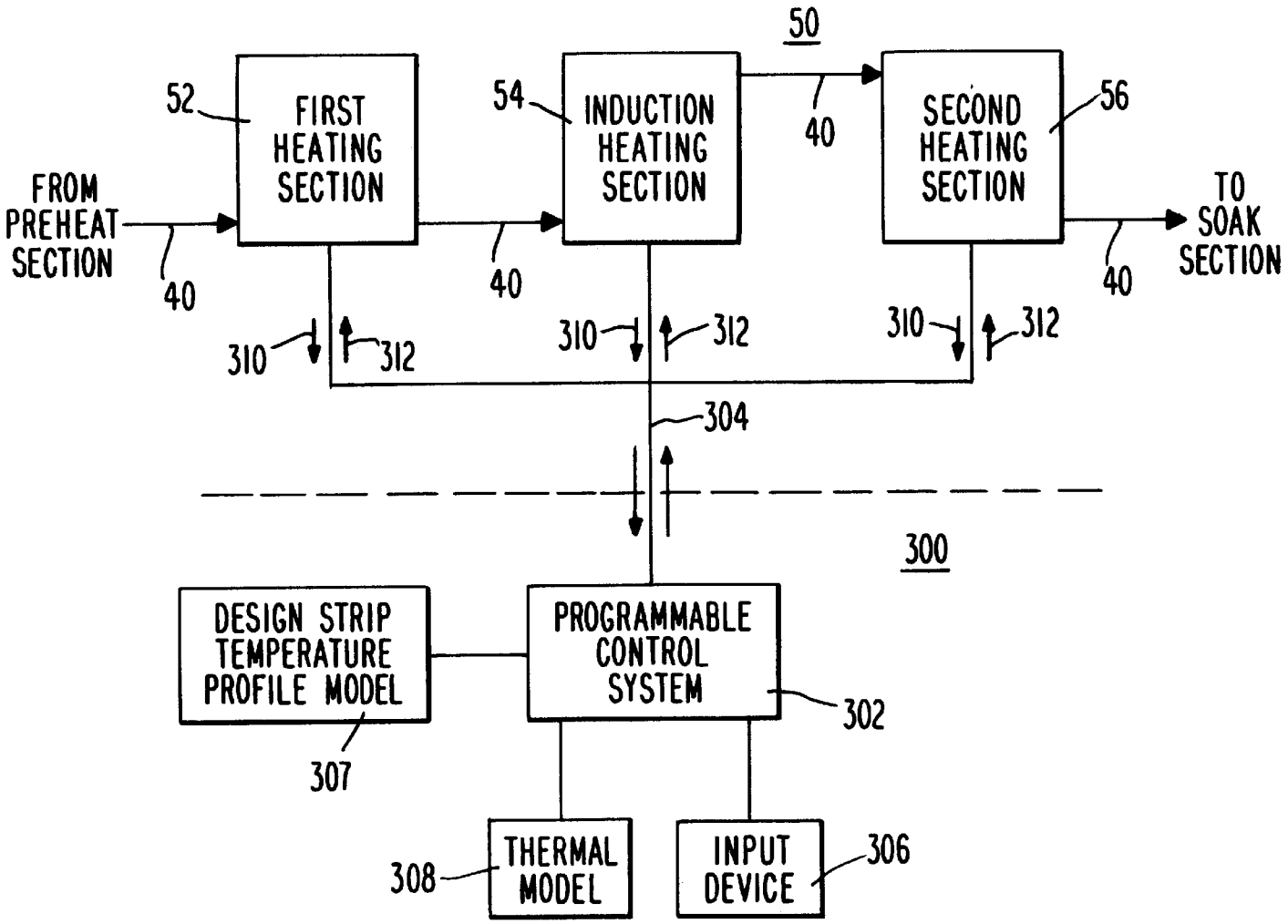
FIG. 4 is a schematic representation of the connection between the heating system and a programmable control means.

Now referring to FIG. 4, in the preferred embodiment of the invention, the tracking of metal strip 40 is optimized by a temperature control means 300 directing the operation of the first heating section 52 and the second heating section 56 to attain an actual strip temperature profile of the metal strip 40 that approximately coincides with the design strip temperature profile. By doing so, each roll 70, tensiometer roll 72, and steering roll 76 will be exposed to its design strip temperature and maintain a proper crown profile on the cylindrical surface of the rolls to achieve proper strip tracking. The control means 300 comprises a programmable control system 302, but other embodiments of the invention may have a controller that is not programmable. The control means 300 directs the heating sections through a conduit 304. In other embodiments of the invention, a wireless transmission system (not shown) may be used in place of or in conjunction with conduit 304. In other embodiments of the invention, the induction heating section 54 may be used to assist in controlling strip temperature.

Instrumentation in the heating system 50 measures at least a portion of the variables (discussed below) of the metal strip 40 and of the heating system 50 and generates variable signals 310. Conduit 304 sends the variable signals 310 from the heating sections to the programmable control system 302. In other embodiments of the invention, at least a portion of the variables are manually inputted into the programmable control system 302 via an input device 306 by a heating system operator.

There are numerous variables that can be received by the programmable control system 302. Some of the metal strip variables include width, thickness, initial temperature, the strip's speed through the heating system 50, and the exit temperature of the strip. Instrumentation may be used to measure a portion of these variables, i.e., thermocouples, distance indicators, speed indicators, etc.

The heating system 50 also has variables that impact the heating of the strip, such as an actual heating system temperature profile of the preceding and following heating sections 52 and 56. In the embodiment of FIG. 3, the preceding and following sections are divided into twelve combustion zones 101–112. Other embodiments of the invention may have more or less zones. At least a thermocouple (not shown) located near the middle of each zone 101–112 measures its zone temperature, respectively, generates signals 310, and transmits the signals to the programmable control system 302, which compiles the actual heating system temperature profile therefrom. Other embodiments of the invention may have different variables or other methods of attaining the variables.

The programmable control system 302 analyzes the variable signals 310 and any manually inputted variables in the context of a thermal model 308 and a design strip temperature profile model 307 to determine new operating parameters for heating system 50. According to the invention, the new operating parameters will result in the actual strip temperature profile approximately coinciding with the design strip temperature profile. The thermal model 308 is a mathematical model that simulates the heat transfer between the heating system 50 and the metal strip 40 and the results of changes in the operating conditions of the heating system to determine new operating parameters. The design strip temperature profile 307 is a mathematical model of the relationship of design strip temperatures at different locations in the heating system. After the analysis, the programmable control system 302 translates the new operating parameters into operating parameter signals 312 that are sent to the heating system 50 via the conduit 304 to direct the operations thereof. In other embodiments of the invention, the operating parameters are determined by a heating furnace operator who either manually, or via a control system, directs the operations of the heating system 50.

Figure 5:
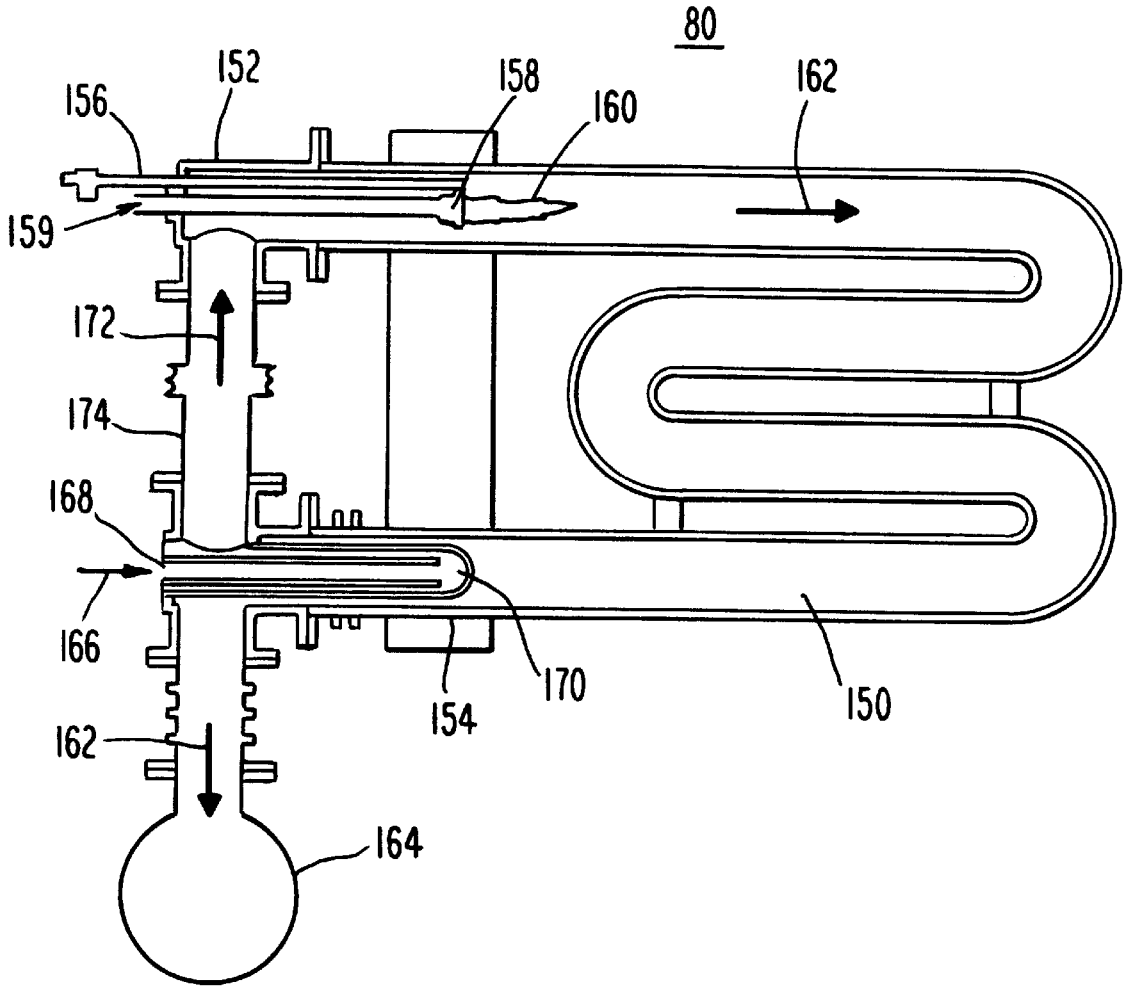
FIG. 5 is a sectional view of a W-type tube heater used in the heating sections.

The operating parameters of the heating system 50 direct different components thereof. Now referring to FIGS. 3 and 5, the heating components of the preceding and following heating sections 52 and 56 are gas-fired, W-type radiant tube heaters 80. These heaters operate in an atmosphere of 0–100% hydrogen with the balance being nitrogen or other designated prepared atmospheric gas. A tube heater 80 is comprised of a hollow tube 150 formed in the shape and orientation of a sideways "W" with a top member 152 and a bottom member 154. A pilot burner 156 and a main gas inlet 158 extend into the top member, providing for gas 159 to enter the tube 150 and be ignited with a flame 160, producing combustion products 162. The pilot burner 156 is a premix-type pilot burner designed for automatic operation. The combustion products 162 travel through the interior of the tube 150 and out bottom member 154 into an exhaust gases collector 164. As the burners are suction-type burners, exhaust fans (not shown) draw the combustion products 162 into the exhaust gases collector 164. Air 166 enters the bottom member 154 through an air inlet 168. The air 166 is heated by the combustion products 162 through the use of a recuperator 170 in the bottom member 154, thereby generating 600° F. to 800° F. warmed air 172 in the preferred embodiment of the invention. The warmed air 172 travels to the top member 152 via a vertical hollow member 174 extending between the top and bottom members. The warmed air 172 is used in combusting gas 158. Other embodiments of the invention use other types, arrangements, and amounts of heaters, such as electrically powered heaters or other gas-burning heaters.

The tube heaters 80 are arranged on both sides of the passes 60 and 64 to heat the metal strip 40 as it travels therethrough. The tube heaters 80 are oriented such that the tubes 150 are parallel to the metal strip 40 as it travels through the passes. The tube heaters 80 are arranged up to approximately eleven tube heaters high on each side of a pass. The placement and control of the tube heaters 80 is designed around the twelve independent combustion zones 101–112 in the preceding and following heating sections 52 and 56, as shown in FIG. 3.

The combustion products 162 may go through additional heat recovery steps after being collected by exhaust gases collector 164. In an embodiment of the invention, the combustion products from zones 101–112 exhaust into two separate exhaust systems. The first exhaust system exhausts zones 101–106 and the waste heat in this stream is used in the preheating section. The second exhaust system exhausts zones 107–112 and the soaking section to a waste heat recovery system. Other embodiments of the invention may not recuperate the waste heat in the preheating zone nor in a waste heat recovery system.

The operating parameter signals 312 direct the rate of firing of the tube burners 80 by means of a control valve in the gas feed of each zone (not shown). The signals 312 also control a damper position to control negative pressure in exhaust gases collector 164 (not shown). Further, the signals 312 vary the speed of the exhaust fans to control the main suction pressure on the exhaust gases collector 164. All of these operations result in the control of the temperatures in the combustion zones 101–112 by the control mechanism 300 through the direction of the signals 312.

The embodiment of the heating system 50 as shown in FIG. 3 has an induction heating section 54 comprising five inductions heaters 82 to electrically heat the strip 40. The induction heaters 82 are solenoid induction heaters. Induction heaters are well known in the art and are described in U.S. Pat. No. 4,678,883 (Saitoh, et al.), U.S. Pat. No. 4,585,916 (Rich), U.S. Pat. No. 4,054,770 (Jackson, et al.), U.S. Pat. No. 3,444,346 (Russell, et al.), and U.S. Pat. No. 2,902,572 (Lackner, et al.), which are incorporated by reference herein in their entireties.

In induction heater 82, the metal strip 40 passes longitudinally through a magnetic field, inducing electrical currents therein. These induced electric currents heat the strip 40 as a result of the electrical resistance of the strip. The magnetic field is generated by electrical current moving through coils in the induction heaters 82 positioned around the metal strip 40 (not shown). The control mechanism 300, through signals 312, directs electrical current to be supplied to the coils of the induction heaters 82. In an embodiment of the invention, the overall length of each coil is approximately 36 inches, with a minimum of approximately 24 inches of space between adjacent coils. The inside coil dimension is approximately 8 inches by approximately 100 inches. The induction heaters 82 are cooled by a closed-loop cooling water system designed to provide a 90° F. liquid cooling medium (not shown). The cooling system comprises an evaporative type cooling tower, a cooling tower fan, a cooling tower circulation pump, and a pumping and delivery system to provide the liquid cooling medium to the induction heaters 80. Other embodiments of the invention include different induction heaters, other configurations of induction heaters, and other means for cooling the induction heaters. In further embodiments of the invention, the induction heating section may be a single induction heater or comprise other electrically powered heaters, i.e., transverse flux and convection heaters.

In the embodiment of the invention as shown in FIG. 3, heat shields 77 shield the rolls 70–76 from the heat of the zones 101–112. By shielding the rolls from the zones 101–112, fluctuations in the temperature of the heating zones will have less of an influence on roll temperature and the cylindrical profile of the rolls. With the zone influence reduced, the optimization of the tracking of strip 40 is more directly related to the approximate coincidence of the actual strip temperature profile to the design strip temperature profile. Other embodiments of the invention have no heat shields or partial heat shields that shield at least a portion of the crowned rolls from at least a portion of the zones.

EXAMPLE

Figure 6:
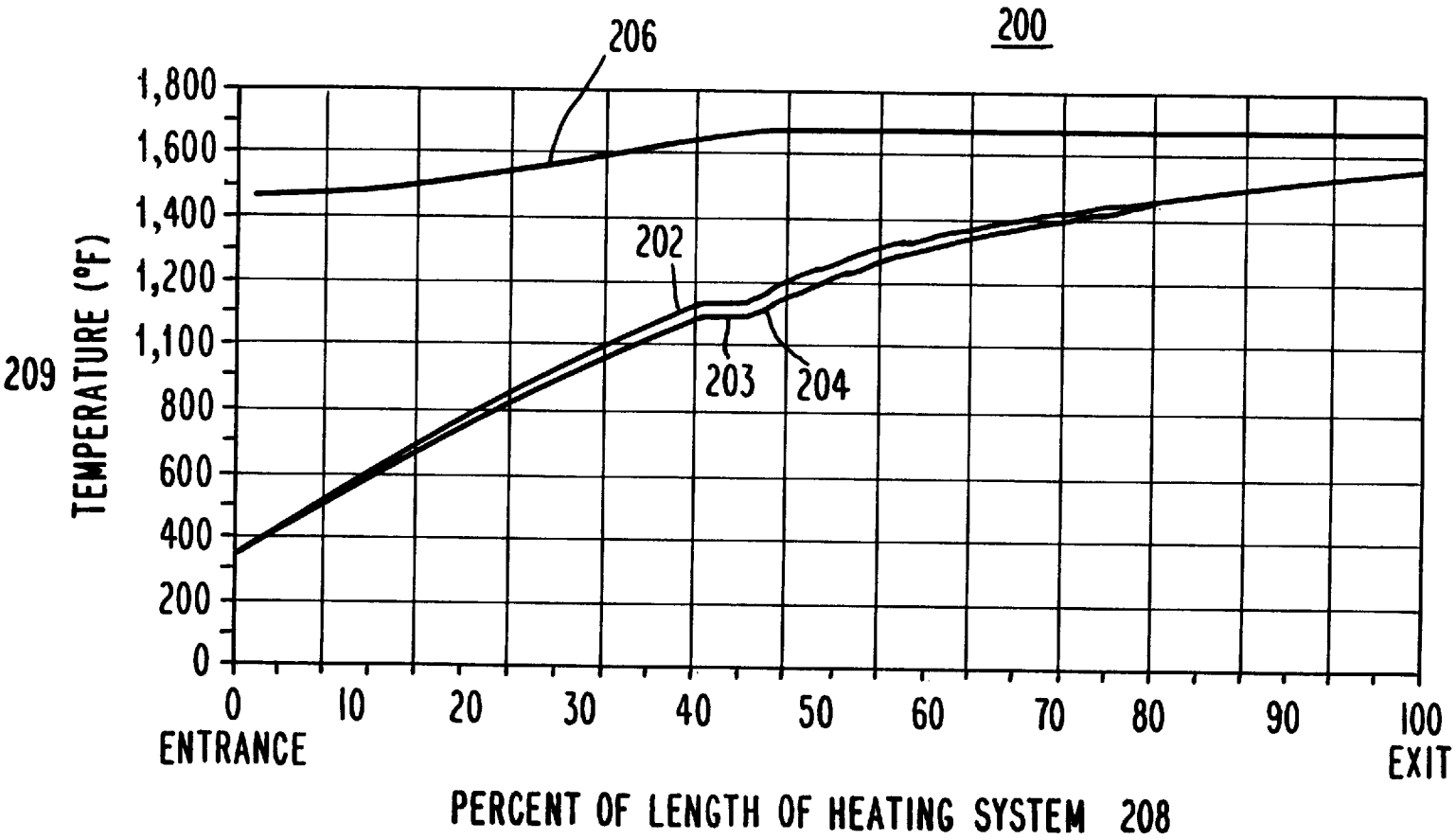
FIG. 6 is a graph of the temperature profiles of the heating system, and actual metal strip, and a design metal strip.

Now referring to FIG. 6, a graph 200 depicts a steady state heating condition of heating system 50 with the metal strip 40 passing therethrough. On the horizontal axis 208, the percent of the length of the heating system is marked off, while the vertical axis 209 marks off temperature. The graph 200 has an actual strip temperature profile curve 202 of metal strip 40, a design strip temperature profile curve 204, and a heating system temperature profile curve 206. The actual strip temperature curve 202 is a plot of the actual strip temperature profile throughout the heating system 50. The design strip temperature profile curve 204 is a plot of the design strip temperature profile throughout the heating system 50. The heating system temperature profile curve 206 is a plot of the heating system temperature profile throughout the heating system 50.

The heating system temperature profile curve 206 is 1480° F. at the entrance of the heating system and 1680° F. at the exit. The actual strip temperature profile curve 202 and the design strip temperature profile curve 204 are approximately coincided with an initial temperature of 350° F. and a peak metal temperature of 1550° F. Note that there is a flat portion 203 of the curves 202 and 204 near the middle of the heating system. The flat portion 203 corresponds to a specific location of the induction heating section 54 in the heating system which is approximately 40% of the way through the heating system. All the locations preceding the induction heating section are in the preceding heating section 52 and all locations following the induction heating section are in the following heating section 56. As the induction heating section is not in use, there is no temperature change for either the actual strip or the ideal strip at the flat portion 203.

With this heating system temperature profile curve 206, the metal strip 40 has attained an actual strip temperature profile 202 that approximately coincides with the design strip temperature profile 204. Under these conditions, the tracking of strip 40 is optimized.

Therefore, by simply and inexpensively directing the heating system 50 to heat the metal strip 40 to an actual strip temperature profile that is approximately coincides with the predetermined temperature strip profile for which the crowned rolls were designed, tracking is optimized. Other embodiments of the invention may make optimizing compromises in the heating a metal strip that requires different actual strip temperature profiles than for which the crowning rolls were designed. Additional embodiments of the invention heat serially-attached metal strips of differing strip variables and, therefore, direct different heating system temperature profiles to accommodate the individual metal strips. Other embodiments of the invention optimize the directing of the different heating system temperature profiles to accommodate serially-attached metal strips of differing strip variables.

The present invention may be embodied in other specific forms without departing from the spirit or essential attributes thereof and, accordingly, reference should be made to the appended claims, rather than to the foregoing specification, as indicating the scope of the invention.

We claim:

1. A method of optimizing the tracking of a metal strip traveling over a plurality of crowned rolls in a continuous heating system designed to track a design strip having a design strip temperature profile comprising attaining an actual strip temperature profile in the metal strip that approximately coincides with the design strip temperature profile, wherein the attaining step further comprises the steps of:

a) inputting metal strip variables of length, width, thickness, strip speed through the heating system, initial strip temperature, final strip temperature, or a combination thereof;

b) inputting heating system variables of an actual heating system temperature profile of the heating system;

c) measuring at least a portion of the metal strip variables and at least a portion of the heating system variables with instrumentation;

d) generating variable signals therefrom;

e) transmitting variable signals to a control system;

f) directing the control system to access a thermal model and a design strip temperature profile model; and g) directing the operation of the heating system based on the metal strip variables, the heating system variables, the thermal model and the design strip temperature profile model with the control system.

2. The method of claim 1, wherein the inputting step, the directing the control system step, or the directing the operation of the heating system step is at least partially performed by a heating system operator.

3. The method of claim 1 wherein the heating system is divided into a plurality of zones, and wherein the inputting the heating system variables step comprises the step of inputting the plurality of zone temperatures of the plurality of zones.

4. The method of claim 3, wherein the plurality of zones comprise a plurality of heater sets, respectively, each heater set having one or more heaters, and the directing the operation of the heating system step comprises the step of directing the operation of the heater sets.

5. The method of claim 4, wherein the heaters are electrically powered heaters or gas powered heaters.

6. The method of claim 5, wherein the heaters are W-type or induction heaters.

7. The method of claim 4, wherein the heating system is part of a continuous strip annealing line or a continuous strip galvanizing line.

8. The method of claim 3, further comprising the step of shielding the crowned rolls from heat of the zones with at least a portion of a heat shield is between at least a portion of the zones and at least a portion of the crowned rolls.

9. A tracking system for optimizing the tracking of a metal strip traveling over a plurality of crowned rolls in a continuous heating system designed to track a design strip having a design strip temperature profile, comprising:

a) a thermal model of the heating system;

b) a design strip temperature profile model;

c) a control system operatively connected to the heating system and capable of accessing the thermal model, accessing the design strip temperature profile model, and directing the heating of the heating system based upon the thermal model, the design strip temperature profile model, metal strip variables, and heating system variables; and d) inputting means for inputting metal strip variables and heating system variables into the control system.

10. The system of claim 9, wherein:

a) the metal strip variables comprise length, width, thickness, strip speed through the heating system, initial strip temperature, final strip temperature or a combination thereof; and b) the heating system variables comprise an actual heating system temperature profile of the heating system.

11. The system of claim 10, wherein the inputting means comprises a manual inputting means for a heating system operator to manually input at least a portion of the metal strip or heating system variables into the control system.

12. The system of claim 10, wherein the inputting means comprises:

a) instrumentation to measure at least a portion of the metal strip variables and at least a portion of the heating system variables and generate variable signals therefrom; and b) transmitting means for transmitting the variable signals into the control system.

13. The system of claim 12, wherein the instrumentation comprises a plurality of temperature measurement means installed in a plurality of zones, respectively, wherein the heating system is divided into the plurality of zones.

14. The system of claim 13, Wherein control system is operatively connected to a plurality of heater sets in the plurality of zones, respectively, the heater sets comprising one or more heaters, respectively.

15. The system of claim 14, wherein the heaters are electrically powered heaters or gas powered heaters.

16. The system of claim 15, wherein the heaters are W-type or induction heaters.

17. The system of claim 14, wherein the heating system is part of a continuous strip annealing line or a continuous strip galvanizing line.

18. The system of claim 13, further comprising at least a heat shield between at least a portion of the crowned rolls and at least a portion of the zones.

* * * * *